United States Patent [19]

Kirk, Jr.

[11] 4,021,983

[45] May 10, 1977

[54] HONEYCOMB BUILDING WALL CONSTRUCTION

[76] Inventor: James D. Kirk, Jr., 40 N. Tower Road, Oak Brook, Ill. 60521

[22] Filed: Feb. 9, 1976

[21] Appl. No.: 656,293

[52] U.S. Cl. ..... 52/451; 52/593; 52/618

[51] Int. Cl.[2] ..... E04B 5/52

[58] Field of Search ..... 52/618, 615, 593, 595, 52/592, 444, 446, 450, 451, 515; 428/116

[56] References Cited

UNITED STATES PATENTS

| | | | |
|---|---|---|---|
| 2,184,714 | 12/1939 | Freeman | 52/593 X |
| 2,501,180 | 3/1950 | Kunz | 52/618 X |

*Primary Examiner*—Price C. Faw, Jr.
*Assistant Examiner*—Carl D. Friedman
*Attorney, Agent, or Firm*—Thomas W. Speckman

[57] ABSTRACT

A building wall structure formed from a plurality of paperboard honeycomb layers adhesively secured to each other in vertical arrangement, each honeycomb layer having a central core of paperboard honeycomb having vertical axes honeycomb and a paperboard closure sheet essentially covering the top and bottom of the core, the opposite long sides of the central core being open on each side and the top closure sheet of one honeycomb layer being adhesively secured to the bottom closure sheet of an adjacent honeycomb layer forming a plurality of paperboard honeycomb layers to the desired wall height. This invention also includes prefabricated walls, prefabricated wall sections, and building blocks to erect the above building wall utilizing minimal on-the-site labor. The walls of this invention are suitable to interior and exterior load bearing walls. The walls of this invention may be directly plastered with materials such as stucco or interior plaster. The building wall structure of this invention provides an inexpensive method of construction which may be erected at the job site with relatively unskilled labor.

10 Claims, 5 Drawing Figures

FIG. 2
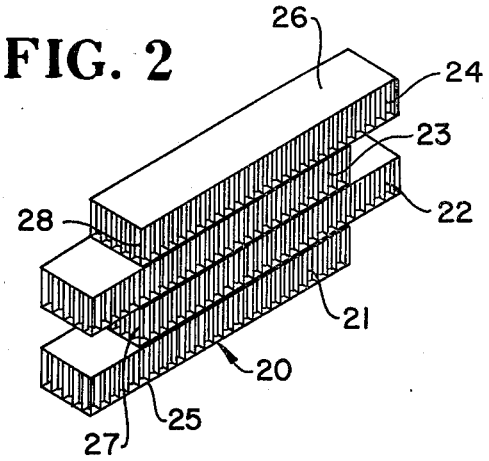
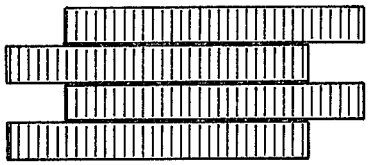
FIG. 3
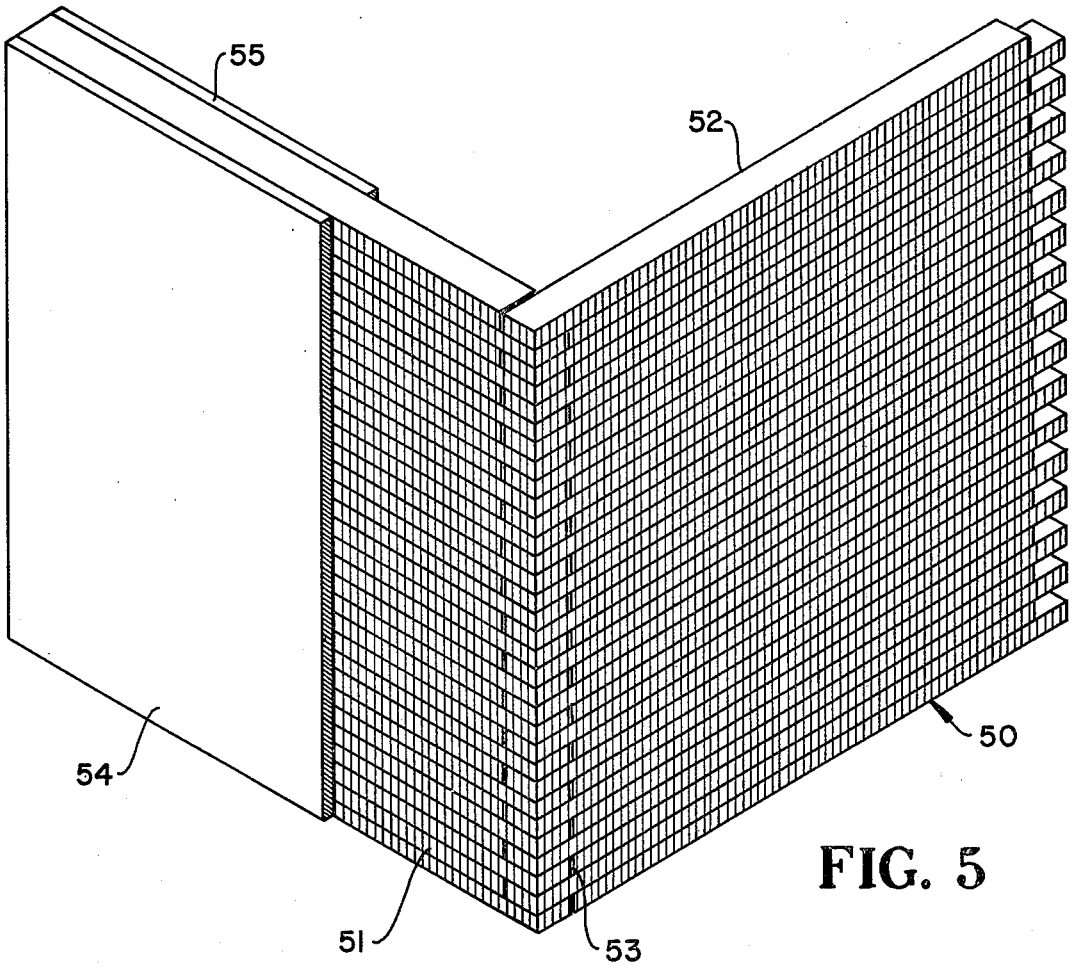
FIG. 5

HONEYCOMB BUILDING WALL CONSTRUCTION

There is a continuing need for improvements in structural materials, particularly those suitable for home and light industry buildings. There is also a need for construction materials which permit rapid erection by relatively unskilled workers. This invention is directed to both of these needs by providing a building wall structure having a plurality of paperboard honeycomb layers adhesively secured to each other in vertical arrangement, each of the honeycomb layers having a central core of paperboard honeycomb having vertical axes and a paperboard closure sheet essentially covering the top and the bottom of the core. The opposite long sides of the cental core honeycomb are open on each side and the top closure sheet of one honeycomb layer is adhesively secured to the bottom closure sheet of an adjacent honeycomb layer forming a plurality of paperboard honeycomb layers to a desired wall height. Utilizing the structure of this invention, an entire load bearing interior or exterior wall or a large section of such wall may be prefabricated at a central location and due to its lightweight and easy erection techniques, may be readily transported and erected at the building site by relatively unskilled workers. Alternatively, any desired size building block may be prefabricated at a central location and shippped for on-the-site construction requiring a minimal amount of skill in the labor force doing the on-the-site erection. When erected, the walls constructed according to this invention may be plastered directly on either side with a cementious substance such as an exterior stucco, interior plaster or may be covered with conventional panels.

There have been previous attempts to utilize paperboard in building construction, but those known to the applicant have only used the paperboard as a component in otherwise conventional building structural sustems. For example, U.S. Pat. No. 3,753,843 teaches a building panel having a core comprised of heavy paper honeycomb material with a seamless covering of moldable material such as synthetic polymers. The molded structural panels formed by the U.S. Pat. No. 3,753,843, when used in conventional wall systems, have the axes of the honeycomb core in a horizontal direction. U.S. Pat. No. 3,883,999 and U.S. Pat. No. 3,798,852 relate to precut, foldable site erected paperboard panels and trusses. The structures of these patents do not provide the desired simplicity of erection nor surfaces on both sides of the wall which may be readily plastered.

It is an object of this invention to overcome the above disadvantages.

It is an object of this invention to provide a building wall structure of paperboard honeycomb layers which may be preassembled in wall units and readily erected at the building site.

It is another object of this invention to provide a building wall structure of paperboard honeycomb layers which may be readily plastered on both sides.

It is a further object of this invention to provide a building block for building wall construction, which building block is made of paper honeycomb layers, alternate layers being offset to form a tongue-and-groove joint with adjacent building blocks.

It is yet another object of this invention to provide a load bearing building wall structure which may be erected at the job site with relatively unskilled labor.

These and other objects, advantages and features of this invention will be apparent from the description and by reference to the drawings wherein preferred embodiments are shown as:

FIG. 2 is a perspective view of one embodiment of a building block according to this invention;

FIG. 3 is a side view of the building block shown in FIG. 2;

FIG. 5 is a perspective corner view of a wall structure of this invention utilizing prefabricated wall sections according to one embodiment of this invention.

Figure 1:
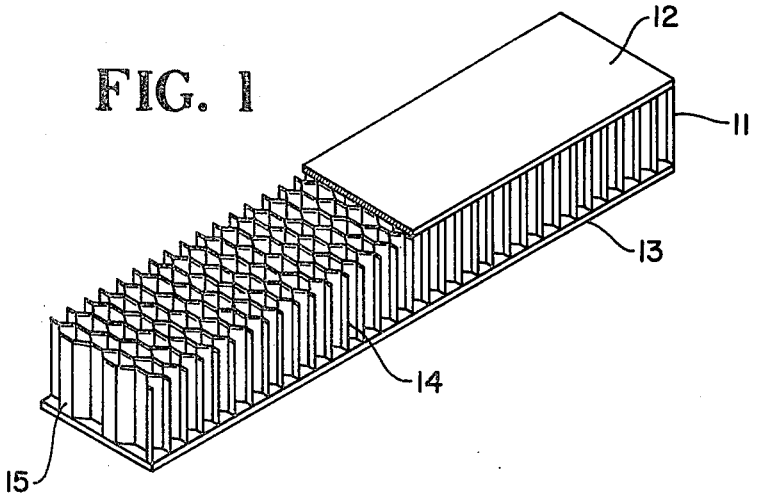
FIG. 1 is a perspective cutaway view of a paperboard honeycomb layer suitable for use in this invention.

FIG. 1 shows a cutaway view of a paperboard honeycomb suitable for use in this invention. The honeycomb board has a central core 11 formed from paperboard including heavy paper such as kraft paper. Throughout this disclosure and claims, the term paperboard is used to include any suitable paper such as kraft paper, laminated paper, thin corrugated paper sheets and other suitable paper sheets. The honeycomb core, due to its internal closed cells, provides excellent thermal and acoustical insulation. The shape and size of the individual honeycomb cells may be modified to obtain desired compression, bending and shear strength of the honeycomb board. The ends of the honeycomb core are covered by closure sheets 12 and 13 which essentially cover the top and bottom of the central core structure. Closure sheets 12 and 13 are also paperboard such as heavy kraft paper which is adhesively secured to the ends of the honeycomb core material. The honeycomb core material shown in FIG. 1 is a hexagonal expanded core wherein the long axes of the core material is transverse to the long axis of the honeycomb board strips as used in this invention. Paperboard honeycomb boards are presently commercially available in various sizes and thicknesses. For use in this invention it is particularly desired to use honeycomb paperboard having a thickness of about 1½ to 4 inches. For use in this invention, the honeycomb paperboard is first cut into strips of the desired thickness of the wall structure, preferably about 1½ to about 6 inches. As shown in FIG. 1, side face 14 and end face 15, as well as their opposite faces, not shown, are cut honeycomb cell structures which are left open to provide a rough surface suitable for aplication of plaster. Thus, the side and end faces have inherent lath characteristics suitable for plastering directly thereby eliminating any need for wire mesh or expanded metal lath.

In one embodiment of this invention, the honeycomb strips as shown in FIG. 1, are cut to desired lengths to make individual honeycomb building blocks such as shown in FIG. 2 as 20. Building block 20 is made by adhesively securing four strips of honeycomb paperboard in the configuration as shown in FIG. 2 having first layer 21, second layer 22, third layer 23, and fourth layer 24. Second layer 22 and fourth layer 24 are offset from the ends of first layer 21 and third layer 23, an amount approximately equal to the width of the building block forming grooves 27 and 28. Thus, in wall construction, the adjacent building block extension layers corresponding to 22 and 24, acting as tongues, extend into grooves 27 and 28 equally well whether it is desired that the adjacent building block be in the same planar relationship or at a 90° planar relationship. I have found that it is desirable to crimp the end of the tongue portions of each layer slightly so that they will be more readily received in the grooves. This may easily be done as the strips are cut to desired length by passing one end of the strip through a roller having the desired narrowing action. It is seen that the building blocks of this invention may be erected into a wall structure by simply assembling adjacent building blocks with adhesive on lower surface 25 and upper surface 26, as well as on the faces of the tongue-and-groove joints at both ends of the blocks. Thus, a unitized wall system may be readily constructed using the building blocks shown in FIGS. 2 and 3.

The building blocks, as shown in FIGS. 2 and 3, may be made at a central location and shipped to the building site for easy erection. The building blocks as shown in FIGS. 2 and 3 may be of any desired size and may preferably have about three to six layers of honeycomb paperboard. FIGS. 2 and 3 show four layers as exemplary only and it is readily seen that one layer may be eliminated making a three-layer block or additional layers may be added in the same fashion. Due to the lightness in weight, it is practical and desired to make the building blocks of this invention considerably larger than presently used building blocks formed from concrete or brick. The building blocks of this invention may be 1 to 4 feet in length and 1 to 4 feet in height and still readily handled by unskilled erection personnel at the job site as well as readily transported to the job site. Preferably, the block is spray coated at the manufacturing site with a moisture resistant coating such as is provided by a wide number of synthetic polymers and paint-type coatings presently available to provide protection during storage and transport and to permit an aqueous plaster or cement to be applied. Any coating providing desired moisture resistance is satisfactory.

Figure 4:
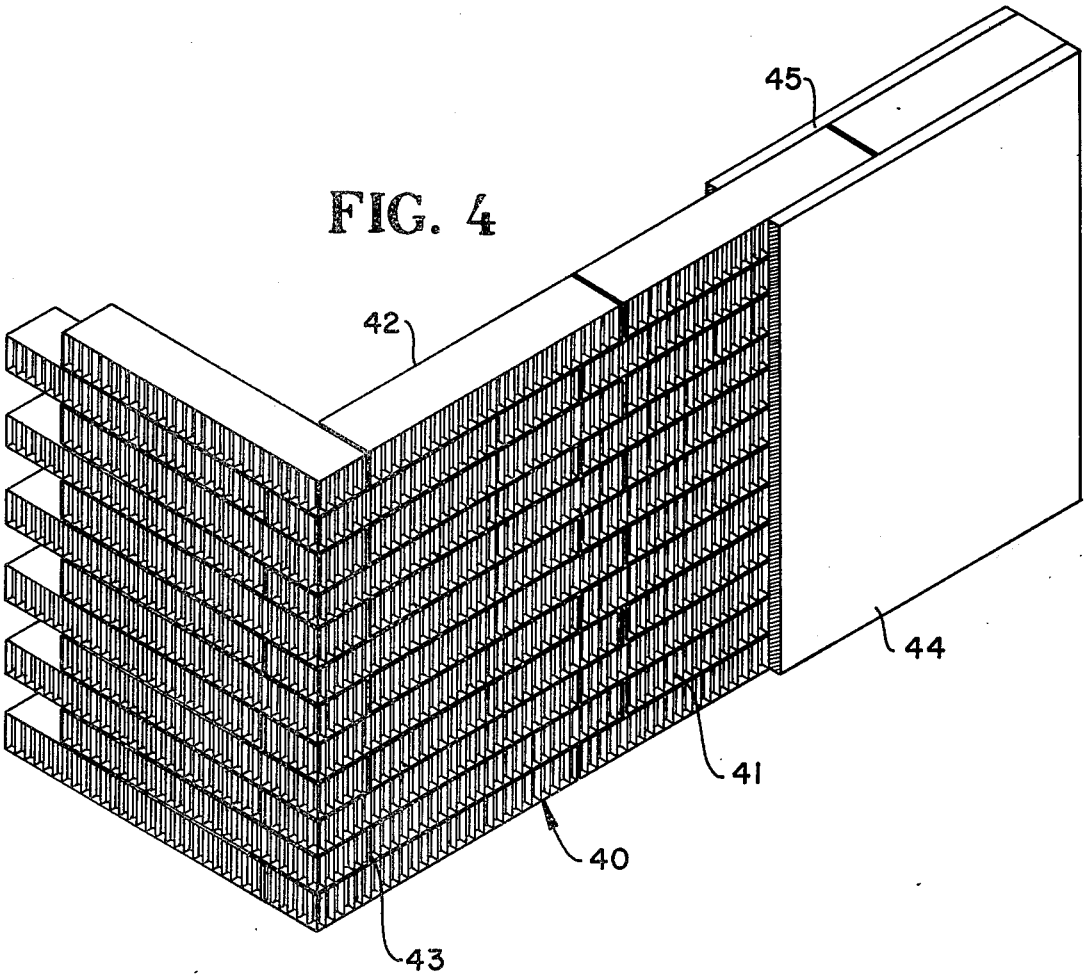
FIG. 4 is a perspective view of the corner portion of a wall structure according to this invention utilizing building blocks as shown in FIG. 2.

FIG. 4 shows one embodiment of a building wall structure constructed of a plurality of building blocks according to this invention such as illustrated in FIGS. 2 and 3. The corner tongue-and-groove structure is clearly shown at corner 43. It is seen that outer face of the block wall 41 provides a roughened surface caused by the cutting of the cellular core. Inner face 42 is the same type surface as outer face 41. It is readily seen that the lower course of building blocks may be placed directly upon a level sill of any nature. The sill upon which the wall is placed may be the top of a concrete foundation or footing or may be a wooden or steel sill supported in any desired fashion. The only requirement being that the sill provide the desired vertical structural support for the wall system. Any desired means of lateral resistance may be supplied at the base of the wall. For example, the bottom course of blocks may be set in a channel shape, may be held by strips on either side, or may be forced over projections sticking up from the sill structure. Likewise, the top of the wall structure of this invention may be secured in any desired manner. For example, rafters or joists may be set directly on a plate attached to the top of the upper course of blocks. A prefabricated roof slab may also be set directly on top of such plate. The building blocks may also be drilled for alignment and reinforcement rod holes which may be provided so that reinforcement rods may be inserted between blocks or extending the entire height of the wall.

Desired outer sheathing 44 may be applied to the exterior of the outer face 41. Outer sheating 44 may be any type of desired exterior finish panel such as wood or metal, which may be adhesively or mechanically attached to outer face 41. For example, conventional wood or metal siding may be attached to outer face 41 by nails or strips having barb projections which may be driven into the honeycomb core for anchoring with or without supplemental fastening by adhesives. The outer face 41, previously coated with moisture resistant coating, is then plastered with a cementious substance such as Portland cement or stucco to provide an exterior weatherproof coating. Likewise, the inner face 42 may be provided with inner sheathing 45 which may be adhesively and/or mechanically secured to inner face 42. Inner face 42 may also have interior plaster applied directly to the coated inner face 42. Thus, it is seen that when the wall system as shown in FIG. 4 is utilized as an exterior wall system, it may be coated with stucco on the outside and coated with plaster on the inside providing a structurally composite system which provides good thermal insulation, desired acoustical properties and fire resistance.

The same wall systems as previously described, utilizing the building blocks of this invention, may be used for interior walls. Such interior walls provide load beaaring wall structures which may be plastered directly on both sides.

FIG. 5 shows another embodiment of this invention wherein an entire wall or wall section is prefabricated and coated with a moisture resistant coating at a central location and rapidly erected by relatively unskilled, on-the-site personnel. The prefabricated wall assembly 50 shown in FIG. 5 has outer face 51 and inner face 52 with the same random cut core, as more fully shown in FIGS. 1 and 4. FIG. 5 is shown in a more stylized manner. Likewise, the prefabricated wall assembly may be covered with the desired outer sheathing 54 and inner sheathing 55 in the same manner as described above. The wall shown in FIG. 5 is erected by simply securing the bottom of the wall to a sill as previously described and securing adjacent wall sections to each other by coating the tongue-and-groove areas with a suitable adhesive and placing adjacent wall sections in their desired positions.

A wide number of suitable adhesives are available, especially synthetic adhesives such as epoxy resins and the like. Any water resistant adhesive providing desired strength is suitable. It is preferred that the adhesive be relatively fast drying or setting to minimize the need for special jigs or temporary bracing.

It is noted that in the erection of both the exterior and interior walls according to this invention, the walls may be erected with no openings or with the larger openings in very rough form since all desired openings may be readily cut for prefabricated doors, windows, and the like, by simply sawing the opening after the wall is erected and prior to installation of the inner and outer sheathings. It is seen from FIG. 5 that large prefabricated wall assemblies may be readily erected at the building site by simple coating the tongue-and-groove end surfaces with adhesive and forcing the adjacent wall assemblies into the desired position.

It is seen that the prefabricated wall assembly and building blocks of this invention provide an extremely lightweight, simply erected, load bearing wall structure which may be utilized for either an interior or exterior wall. The wall construction according to this invention, is particularly suited for use in those parts of the world where paper pulp is in good supply and experience on-the-site construction labor is not available. It is seen that a wide variety of relatively simple one-story housing structures may be rapidly and inexpensively produced while affording a sturdy insulating structure. The wall structure of this invention may be plastered on both sides with a locally available adobe-type clay or various mud compositions.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A building wall structure comprising a plurality of paperboard honeycomb layers adhesively secured to each other in vertical arrangement; each said honeycomb layer having a central core of paperboard honeycomb cells having vertical cell axes and a paperboard closure sheet essentially covering the top and bottom of said core, the opposite long sides of said central core honeycomb being open on each side; the top closure sheet of one honeycomb layer adhesively secured to the bottom closure sheet of an adjacent honeycomb layer forming a plurality of paperboard honeycomb layers to the desired wall height.

2. The building wall structure of claim 1 wherein the alternate honeycomb layers are offset an amount approximately the thickness of said wall to form a tongue-and-groove end joint with an adjacent similar building wall structure having corresponding alternate honeycomb layers oppositely offset at their ends.

3. The building wall structure of claim 1 wherein the opposite sides of said wall having open honeycomb core structure have a moisture resistant sealant coating.

4. The building wall structure of claim 3 wherein at least one side of said open honeycomb core structure is covered with a cementious material.

5. The building wall structure of claim 4 wherein said cementious material is plaster.

6. The building wall structure of claim 4 wherein said cementious material is stucco.

7. The building wall structure of claim 1 wherein said wall comprises a plurality of building blocks, each of said building blocks comprising a plurality of paperboard honeycomb layers adhesively secured to each other in vertical arrangement; each said honeycomb layer having a central core of paperboard honeycomb cells having vertical cell axes and a paperboard closure sheet essentially covering the top and bottom of said core, the opposite long sides of said central core honeycomb being open on each side; the top closure sheet of one honeycomb layer adhesively secured to the bottom closure sheet of an adjacent honeycomb layer forming a plurality of paperboard honeycomb layers to the desired building block height, the ends of said building blocks having alternate honeycomb layers offset to form a tongue-and-groove joint with adjacent building blocks.

8. The building wall structure of claim 1 wherein said wall comprises a plurality of prefabricated wall sections, each of said prefabricated wall sections comprising a plurality of paperboard honeycomb layers adhesively secured to each other in vertical arrangement, each said honeycomb layer having a central core of paperboard honeycomb cells having vertical cell axes and a paperboard closure sheet essentially covering the top and bottom of said core, the opposite long sides of said central core honeycomb being open on each side; the ends of said prefabricated wall sections having alternate honeycomb layers offset to form a tongue-and-groove joint with adjacent prefabricated wall sections.

9. A building block for building wall construction comprising a plurality of building blocks, each of said building blocks comprising a plurality of paperboard honeycomb layers adhesively secured to each other in vertical arrangement; each said honeycomb layer having a central core of paperboard honeycomb cells having vertical cell axes and a paperboard closure sheet essentially covering the top and bottom of said core, the opposite long sides of said central core honeycomb being open on each side; the top closure sheet of one honeycomb layer adhesively secured to the bottom closure sheet of an adjacent honeycomb layer forming a plurality of paperboard honeycomb layers to the desired building block height, the ends of said building blocks having alternate honeycomb layers offset to form a tongue-and-groove joint with adjacent building blocks.

10. The building block of claim 9 having 3 to 6 of said layers.

* * * * *